US005291539A

United States Patent [19]

Thumann et al.

[11] Patent Number: 5,291,539

[45] Date of Patent: Mar. 1, 1994

[54] VARIABLE FOCUSSED X-RAY GRID

[75] Inventors: Gary J. Thumann, Oconomowoc; Jonathan C. Boomgaarden, Waukesha; Daniel P. Miller, New Berlin, all of Wis.

[73] Assignee: General Electric Company, Milwaukee, Wis.

[21] Appl. No.: 963,956

[22] Filed: Oct. 19, 1992

[51] Int. Cl.[5] ..... G21K 1/00

[52] U.S. Cl. ..... 378/154; 378/150; 378/155

[58] Field of Search ..... 378/154, 155, 145, 147, 378/149, 150, 152, 153

[56] References Cited

U.S. PATENT DOCUMENTS 1,948,270 2/1934 Liberson ..... 378/155

4,361,899 11/1982 Amplatz ..... 378/154

4,780,904 10/1988 Winter ..... 378/154

4,987,581 1/1991 Bernardi ..... 378/154

FOREIGN PATENT DOCUMENTS 1141914 9/1957 France ..... 378/154

*Primary Examiner*—David P. Porta

*Attorney, Agent, or Firm*—James J. Lichiello; James O. Skarsten

[57] ABSTRACT

A flexible elongated slatted grid structure is suspended between a pair of spaced apart grid support frames each of which is adapted for rotation about a transverse axis intermediate the suspended ends of the grid. Mechanical adjustment means provides equal but opposite angular motion of the frames to curve the grid along a circular path.

12 Claims, 2 Drawing Sheets

VARIABLE FOCUSSED X-RAY GRID

This invention relates to a variable focussed X-ray grid and more particularly to the focussed grid and its adjusting or focussing means.

X-ray grids are usually employed to remove secondary or scatter radiation c)f X-rays which are generated or occur when X-rays pass through an object to be examined and prior to X-ray passage into an X-ray sensitive medium or X-ray film. Such grids are constructed and arranged to permit the passage therethrough of X-rays which have not been deflected or redirected by the object to be examined, but to block those X-rays which have been so deflected or redirected. After passing through the grid the X-rays form an X-ray image on an X-ray sensitive medium or film. Ordinarily, X-ray grids of the kind described are fixed focus grids adapted for predetermined SID (source to image distances) and their use at other distances not only gives less than optimum results, but also usually involved an undesirable increase in X-ray radiation. In some instances where the source to image distance, SID, may be in the 100 to 180 cm. range, grid selection becomes a problem. If a fixed grid with a 100 cm. focus is employed, best results and optimum efficiency will be achieved at 100 cm. while at 180 cm. the grid will perform poorly because X-ray primary beam transmission is reduced or grid cutoff is large. If a fixed grid with a compromise focus between 100 and 180 cm. is employed, there may be an undesirable increase in X-ray dosage to the object (human body parts, for example) being penetrated by the X-rays. Having remarkable grid capability with automatic or manual selective means adds complexity for the user of the equipment.

OBJECTS OF THE INVENTION

Accordingly, it is a principal object of this invention to provide a variable focussed SID X-ray grid.

It is another object of this invention to provide a variable focus SID X-ray grid with manual or electric drive means for the focussing function.

SUMMARY OF THE INVENTION

An elongated X-ray grid structure is suspended between a pair of spaced apart grid support frames adapted for limited rotation about an axis intermediate the suspended ends of the grid. Mechanical adjustment means connected to the frames provides opposite limited equiangular rotation of the frames to impose a bending moment in the grid to bow the grid along a circular path to change its focus.

This invention will be better understood when taken in connection with the following drawings and description.

DESCRIPTION OF A PREFERRED EMBODIMENT

Figure 1:
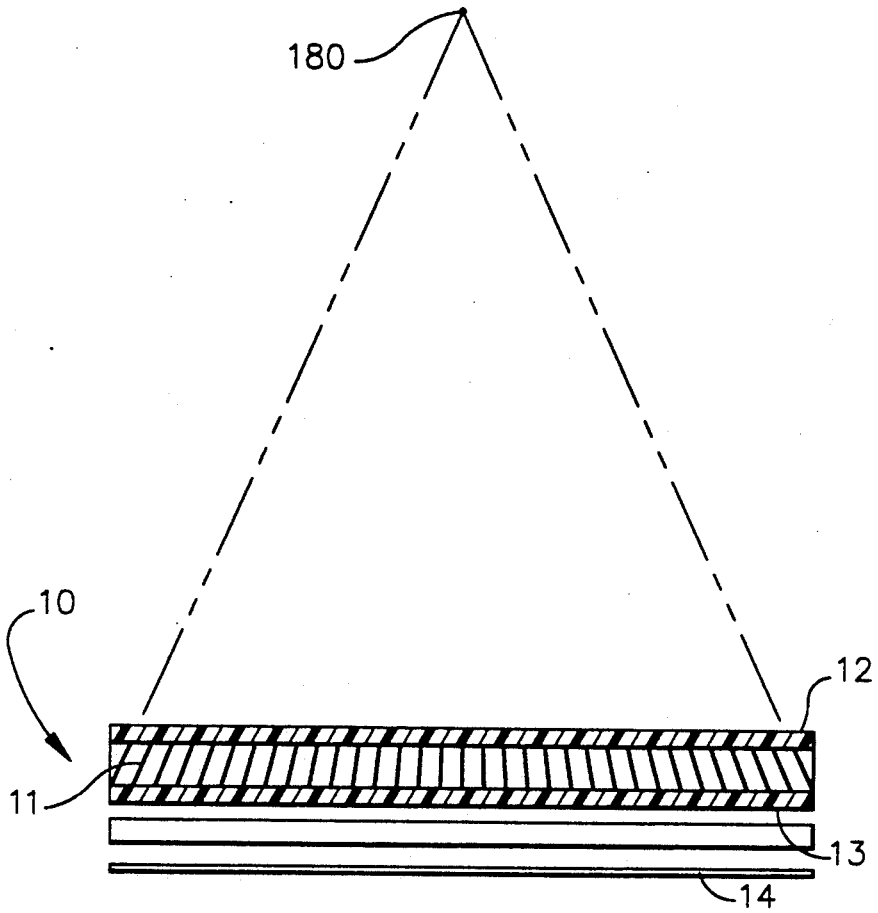
FIG. 1 is a partial and schematic illustration of an X-ray grid which may be utilized in this invention.

Referring now to FIG. 1, X-ray grid structure 10 comprises a spaced array of edge mounted parallel grid slats 11 retained within skin covers 12 and 13. In one form of this invention, grid 10 comprised metal slats 11 of lead (Pb) with covers 12 and 13 being of a carbon fiber material. In one practice of this invention, carbon fibers or filaments in covers 12 and 13 extended along the grid transversely to the direction of slats 11. This orientation lends a better degree of stiffness and resiliency to the grid. As illustrated in FIG. 1, grid 10 in its unflexed condition includes slats 11 positioned at predetermined angles to the perpendicular. In this manner, when grid 10 assumes its flexed or bowed position for a chosen SID, the angular position of slats 11 will be optimized for X-ray imaging on an X-ray sensitive medium or film denoted generally as 14 in FIG. 1. However, a purely parallel grid structure wherein all grid slats are perpendicularly parallel to each other may also be employed in this invention, and appropriately flexed or bowed to provide a desired change in the SID for the grid. As known in the art, the space between slots 11 may be filled with or contain one or more of the many known low X-ray dosage materials, both metals and non-metals, which are conducive to the primary function of such grids which is in the nature of filtering or screening the passing X-rays to pass those which proceed directly from the X-ray source to the X-ray film and deter those which are dispersing or not proceeding directly. The planar grid 10 as described will provide an X-ray focus at a predetermined and fixed distance depending on a SID to be employed. However, it may be desirable to use a grid where a SID may be in a range of, for example, 100 to 180 cm. For a single grid use in an SID range of values, the variable concept of this invention will provide precise grid variation to accommodate different SIDS. For example, a grid 10 as described may have a fixed X-ray focus at 180 cm. and be appropriately flexed to have an X-ray focus at 100 cm. By calculation, the original angles of the grid slats 11 for 180 cm. SID will arrive at an appropriate 100 cm. SID focus when the grid is adjustably curved or bowed in accordance with this invention. As schematically illustrated in FIG. 1, grid 10 in its unflexed position as shown, provides proper X-ray focus for an X-ray source denoted as point 180 which is 180 cm. from image receptor 14. By means of this invention, grid 10 may be adjustably flexed to provide a different focus as shown in FIG. 2.

Figure 2:
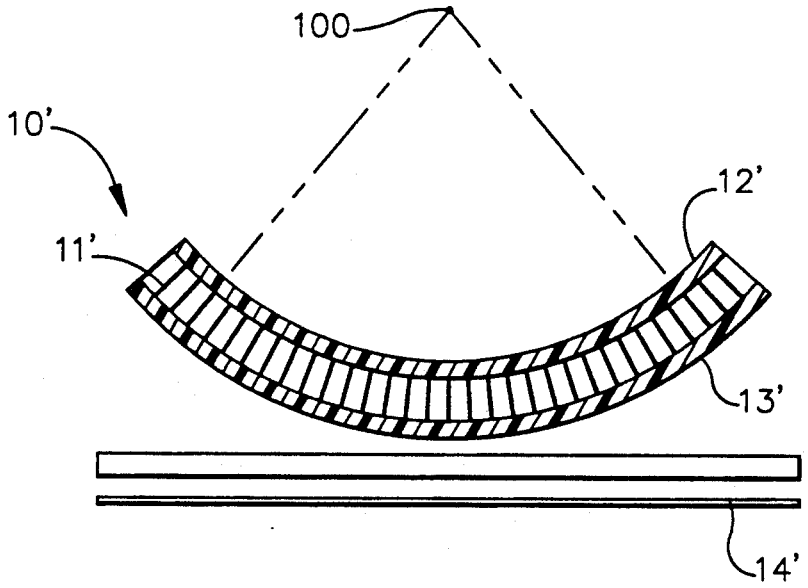
FIG. 2 is a schematic illustration of the grid of FIG. 1 in its bowed or flexed operative position.

Referring now to FIG. 2, grid 10 of FIG. 1 is appropriately adjusted to provide flexed grid 10' of FIG. 2 with a focus of 100 cm. as compared to 180 cm. for unbowed grid 10 of FIG. 1. A preferred adjustment arrangement in accordance with this invention is best described with respect to FIG. 3.

Figure 3:
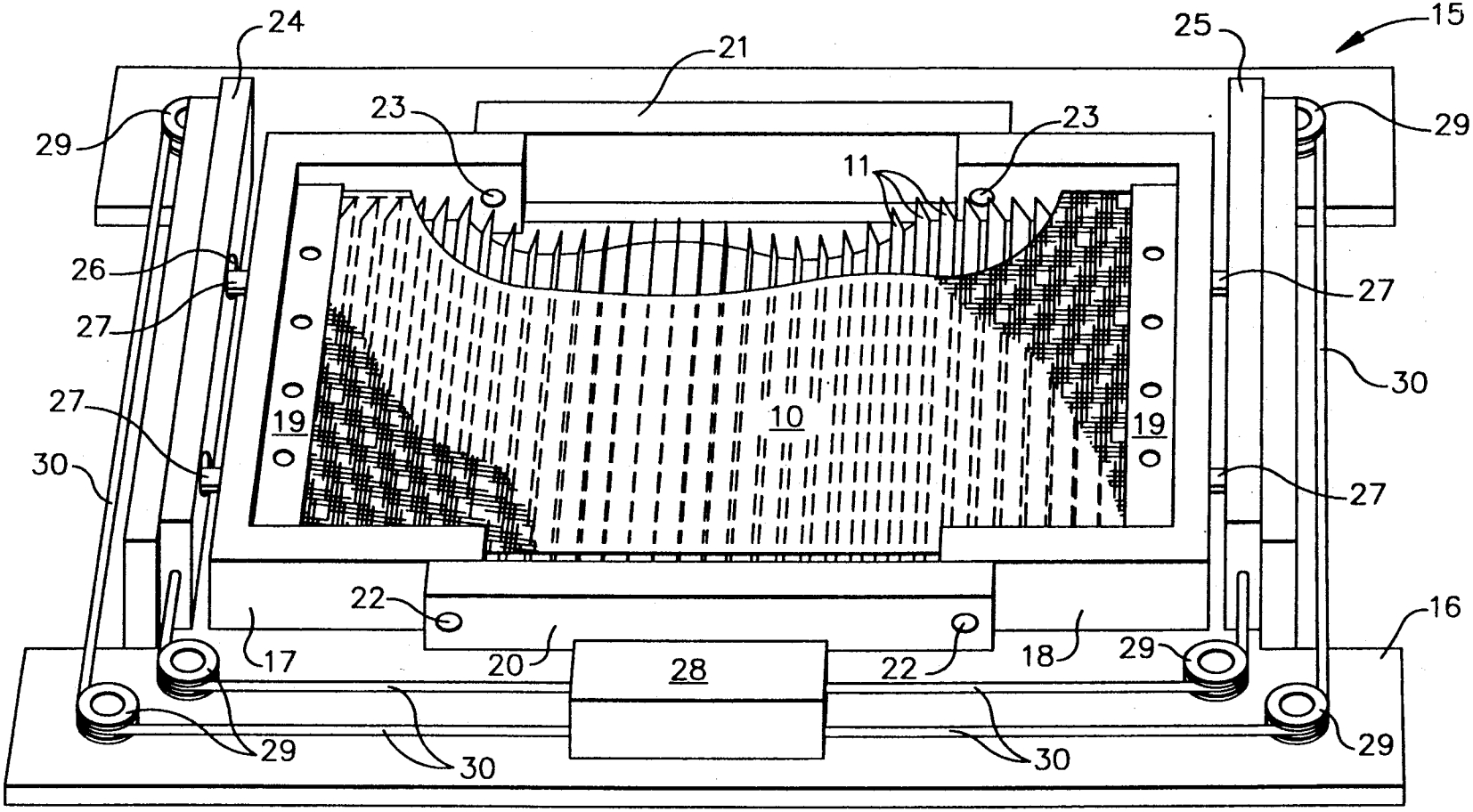
FIG. 3 is a perspective schematic illustration of one mechanical assembly for grid supporting and focussing.

Referring now to FIG. 3, grid adjusting assembly 15 comprises a frame 16 which supports a grid 10 and its cooperating variable focus mechanism. A pair of spaced apart grid supporting members 17 and 18 are arranged on frame 16 as suspension supports for grid 10. In one example, support members 17 and 18 are rectangular U members in open grid-to open end opposed relationship with their opposed projecting arms in parallel and concentric relationship. The ends of grid 10 are suitably attached to the insides of the cross arms of grid support members 17 and 18 by means of intermediate or transition straps 19. U members 17 and 18 are connected to each other by means of opposite links 20 and 21 passing along the opposes arms of the U members and connected to those arms by means of opposed pairs of pins or pivots 22 and 23. As illustrated, links 20 and 21 and pivots 22 and 23 permit each U member to rotate about a transverse axis which passes transversely through pivots 22 and 23 and parallel with the cross arms of the U members. Also, this axis is intermediate the attached ends and the center of grid 10. U members 17 and 18 are free to rotate from the plane of frame 15 while link members 20 and 21 remain fixed.

With grid 10 attached to U members 17 and 18 as illustrated, equal and opposite rotational movement of the U members will cause both U members to rotate upwardly, for example, (from the viewers perspective). During this angular movement, the described path of the cross arms or bases of the U members will be a short distance along a half circle which essentially brings the cross arms of u members 17 and 18 (closer to each other for a resultant bowing or curving of the suspended grid 10 to the configuration of grad 10' of FIG. 2.

More specifically, rotation of one U member such as member 17 through a predetermined angle of rotation, upwardly and clockwise, for example, from the viewers perspective, and corresponding opposite and counterclockwise rotation of member 18 through the same angle causes the attached edges of the grid to flex through the same angle while impressing a constant bending moment in the grid at the predetermined angle. The curving of the grid as a result of the bending moment is essentially circular with a grid having covers 12 and 13 of constant bending stiffness. The location of the pivot pairs 22 and 23 is chosen so that at two predetermined angles, for example, at opposite limits of a predetermined adjustment range, the separation between the edges of grid which are attached to grid support elements 17 and 18 is equal to the value which would result if the grid were flexed along a perfect circle. The location of the pivot pins 22 and 23 is also constrained or fixed so that at both limits of adjustment, any displacement of the center of the grid toward or away from the X-ray source, is essentially 0.0. Accordingly, grid adjustment is not fixed precisely at an SID of 100 cm. and 180 cm. At intermediate adjustment positions, the bowed shape continues to be essentially circular since the actual adjustment is usually quite small over the range of required conditions. As further illustrated in FIG. 2, each U member 17 and 18 is caused to rotate about its own transverse axis which passes through opposite pairs of pins 22 and 23. This transverse axis for either U member 17 or 18 is located intermediate the midpoint of the grid (between its attached ends) and the attached ends of the grid. This location favorably influences the circular flexing of the grid.

Various means may be employed to provide rotational and incrementally positive adjustment of the grid support elements 17 and 18 for corresponding grid adjustment.

One example of a mechanical adjustment means is also illustrated in FIG. 3.

Referring again to FIG. 3, narrow rectangular cam plates 24 and 25 are positioned in parallel side to side abutting relationship along the base of each cross arm of U members 17 and 18. Each cam plate contains an elongated cam slot 26 and is positioned at the base of a U member for reciprocating motion along the U member base. As illustrated in FIG. 2, cam pins 27 protrude from the base of the cross members to reside in the cam slots 26. Cam slots 26 are predeterminedly angularly disposed in the cam plates so that, upon axial or reciprocating motion of the cam plates, cam pins 27 follow the slots and cause elevation or depression rotation of the U members through an angle correlated to the cam slot angle. The described adjustment may be obtained through electrical or manual means. One electrical means is illustrated schematically in FIG. 3. For example, in FIG. 3, an appropriate electrical motor drive means 28 is connected to cam plates 24 and 25 through a series of pulleys 29 and cables 30 so that actuation of drive means 28 moves appropriate cables to linearly adjust or move cam plates 24 and 25. Cams 24 and 25, and their cable and pulley arrangement, are correlated so that cam plates 24 and 25 move in unison with each other. Appropriate manual means may be substituted for the electric drive means to manually adjust the cables for resulting cam plate motion, for example, a manually rotatable winding reel or pulley may be employed for imparting cable motion.

This invention provides a unique variable focussed X-ray grid particularly for clinical X-ray operations where fixed grids are not only unduly restrictive for intermediate SID distances, but also may lead to undesirable increase in X-ray dosage. The variable focussed grid of this -invention permits a single grid to be utilized, for example, at source to image distances of 100 and 180 cm.

By means of this variable focussed X-ray grid invention, the usual X-ray grid transmission losses which are due to a distance positioning error with respect to grid focus, are greatly reduced with a resultant less X-ray exposure for a patient undergoing X-ray examination of a body part. The variable focus grid arrangement is expeditiously adapted for use with a parallel or nonfocus grid, or a prefocused grid and, in either event, flexes the grid in a circular configuration with a radius which aligns the grid slots to the focal point of the X-ray source.

While this invention has been disclosed and described with respect to preferred embodiments, it will be understood by those skilled in the art that various changes and modifications may be made without departing from the spirit and scope of the invention as set forth in the following claims.

What is claimed is:

1. Adjustment means for a variable focussed X-ray grid comprising in combination (a) a pair of spaced apart grid support members supported for individual equal and opposite angular rotation, (b) a flexible resiliently stiff grid structure attached to and suspended between said grid support members, (c) adjustment means to adjustably rotate said support members in unison through equal but opposite angles to cause said resiliently stiff grid to bow therebetween to define a circular arc between said support members.

2. The invention as recited in claim 1 wherein said X-ray grid comprises (a) an elongated thin rectangular structure, (b) an extended spaced array of edge mounted transverse slats in said structure to define a slatted grid work, (c) and a thin skin membrane of a low dosage X-ray material coextensively covering and attached to opposite sides of said grid structure for improved grid structure stiffness and resiliency.

3. The invention as recited in claim 2 wherein said slats comprise lead, Pb.

4. The invention as recited in claim 2 wherein said thin skin membrane comprises a low X-ray dosage carbon fiber material.

5. A variable focussed X-ray grid assembly comprising in combination (a) a pair of spaced apart grid support members supported for individual equal and opposite angular rotation in unison, (b) a flexible resiliently stiff X-ray grid attached to and suspended between said support members, (c) movable cam means interconnected with each said support members to rotate said support members, (d) drive means operatively connected to said cam means to simultaneously move said movable cam means to equally and oppositely rotate said support members in unison to impose a bending moment in said grid to bow said grid therebetween into an essentially circular arc.

6. The invention as recited in claim 5 wherein said drive means comprises a pulley and cable system to move said movable cam means.

7. The invention as recited in claim 5 wherein said drive means comprises an electric Motor drive means.

8. The invention as recited in claim 5 wherein said interconnected cam means comprises a movable cam having a cam slot therein and a cam pin on an adjacent support member projecting into said slot.

9. The invention as recited in claim 5 wherein each of said grid support members is adapted to rotate about a transverse axis which is intermediate the midpoint of the grid and the attached ends of the grid.

10. The invention as recited in claim 5 wherein said support members comprise a pair of rectangular U members positioned in spaced apart opposed and parallel relationship with the arms of the U members in concentric opposed relationship.

11. The invention as recited in claim 10 wherein said grid is attached to and suspended from between the cross arms of said U members.

12. The invention as recited in claim 10 wherein each said U member is adapted for limited rotation about its own axis which passes transversely through its arms, said axis being between the midpoint of said grid and a U member cross arm.

* * * * *